US006290787B1

(12) United States Patent
Babbit et al.

(10) Patent No.: US 6,290,787 B1
(45) Date of Patent: Sep. 18, 2001

(54) PROCESS FOR MANUFACTURING DRAWABLE SHEET BY DIRECT CASTING OF THIN STRIP, AND SHEET THUS OBTAINED

(75) Inventors: Michel Babbit; Michel Faral, both of Metz; Catherine Juckum, Paris; Hélène Regle, Corny sur Moselle, all of (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/597,407

(22) Filed: Jun. 19, 2000

(30) Foreign Application Priority Data

Jun. 17, 1999 (FR) ..... 99 07660

(51) Int. Cl.[7] ..... C21D 8/02
(52) U.S. Cl. ..... 148/541; 148/546; 148/653
(58) Field of Search ..... 148/546, 541, 148/653

(56) References Cited

U.S. PATENT DOCUMENTS 5,832,985 * 11/1998 Pleschiutschnigg et al. ..... 164/4.76

FOREIGN PATENT DOCUMENTS

306076-A1 * 3/1989 (EP) .
60-077928-A * 5/1985 (JP) .
05-059447-A * 3/1993 (JP) .

* cited by examiner

*Primary Examiner*—George Wyszomierski
*Assistant Examiner*—Janelle Combs-Morillo
(74) *Attorney, Agent, or Firm*—Oblon, Spivak, McClelland, Maier & Neustadt, P.C.

(57) ABSTRACT

The subject for the invention is a process for manufacturing strip. The process includes casting directly from liquid metal a steel strip 1.5 to 10 mm in thickness, subjecting the cast steel strip, in the austenitic phase, to a first hot rolling operation in one or more steps at a temperature of between 950° C. and the $Ar_3$ temperature of said strip with an overall reduction ratio of at least 10%, then subjecting the hot rolled strip, in the ferritic phase, to a second hot rolling operation in one or more steps at a temperature below 850° C., with an overall reduction ratio of at least 50% in the presence of a lubricant, so as to obtain a hot-rolled sheet with a thickness of less than or equal to 2 mm, and recrystallizing the hot rolled sheet at a temperature between 700 and 800° C. The composition of the steel strip comprises (in weight %): carbon less than 0.1%, manganese from 0.03 to 2%, silicon from 0 to 0.5%, phosphorus from 0 to 0.1%, boron from 0 to 0.002%, titanium from 0 to 0.15%, balance iron and impurities.

18 Claims, No Drawings

PROCESS FOR MANUFACTURING DRAWABLE SHEET BY DIRECT CASTING OF THIN STRIP, AND SHEET THUS OBTAINED

BACKGROUND OF THE INVENTION

1. Field of the Invention

The invention relates to the manufacture of thin steel sheet which can be drawn. More specifically, it relates to strip and sheet made of ultralow-carbon and low-carbon ordinary steel.

2. Description of the Background

Conventionally, thin strip (thickness from 0.5 to 1.5 mm) made of carbon steel intended to be drawn, and used for example in the motor-vehicle industry, is obtained by the following manufacturing line:

- continuous casting of slab approximately 200 mm in thickness;
- hot rolling of said slab until strip about 4 mm in thickness is obtained;
- cold rolling, annealing (box or continuous annealing) and passage through a skin-pass mill of said strip (operations referred to by the term "cold treatments," even if for some of them, such as the annealing, a reheat is necessary) the strip then being cut up in order to obtain sheet.

The composition of this sheet may be summarized as follows (the percentages are percentages by weight).

In the case of so-called "low-carbon" sheet, the carbon content must be less than 0.1%, preferably less than 0.03%, with even more preferably a sum of the carbon and nitrogen contents which is less than 0.03%, a manganese content of between 0.03 and 0.3%, a silicon content of between 0.05 and 0.3% and a phosphorus content of between 0.01 and 0.1%. When it is desired to have sheet having a particularly high strength, the carbon content must be less than 0.03% and the manganese content must be between 0.3 and 2%. Additions of boron (up to 0.008%) and of titanium (from 0.005 to 0.06%) into the low-carbon sheet are also possible.

In the case of so-called "ultralow-carbon" sheet, the carbon content must be less than 0.007% and preferably the nitrogen content must also be very low, not exceeding a few tens of ppm. The contents of the other elements are the same as in the case of the low-carbon sheet with, optionally, microadditions of titanium (from 0.005 to 0.06%) and/or of niobium (0.001 to 0.2%).

A process that can replace the above one consists in casting the steel at the exit of the continuous casting mold into thin slab (thickness of 40 to 100 mm, for example) and then in hot rolling it in mill stands in line with the casting plant, this rolling possibly including various steps during which the steel is in the ferritic or austenitic state (see WO 97/46332 incorporated herein by reference). In this process, at least one slab reheat, prior to the first hot rolling, is necessary, as are subsequent cooling and reheating steps allowing the desired metallurgical transformations of the product to be carried out. It is thus possible to produce various types of product, especially sheet with a high formability for the motor-vehicle industry. The present invention is distinct from that described in WO 97/46332.

In the prior processes, using conventional hot rolling mills to obtain the final strip thickness before it is cold rolled, the speed at which the strip leaving the hot rolling plant runs is about 600 to 950 m/min., depending in particular on the thickness of the product. These speeds are relatively high compared with, in particular, the usual speeds at which the products run through the plants to carry out the "cold" treatments of the strip obtained in the rest of the manufacturing process, for example in compact annealing, dip-coating or electroplating lines. This causes differences in productivity between these various plants, differences which require the products to be stored in their intermediate states in the form of coils, while waiting for the "cold" treatments. This results in non-optimal product-flow management, even in the most favorable case in which all the plants—for casting, rolling and "cold treatments"—are grouped together on the same industrial site.

SUMMARY OF THE INVENTION

One object of the invention is to provide a method of manufacturing highly drawable sheet having a greater productivity than conventional methods, for example by shortening the manufacturing lines.

For this purpose, one subject of the invention is a process for manufacturing drawable steel sheet obtained from strip, wherein:

- a steel strip from 1.5 to 10 mm in thickness having a composition in percentages by weight that comprises, consists essentially of, or consists of: carbon less than 0.1%, manganese from 0.03 to 2%, silicon from 0 to 0.5%, phosphorus from 0 to 0.1%, boron from 0 to 0.002%, titanium from 0 to 0.15%, iron and impurities resulting from the smelting, is cast directly from liquid metal;
- said strip, in the austenitic phase, then undergoes a first hot rolling operation in one or more steps at a temperature of between 950° C. and the $Ar_3$ temperature of said strip with an overall reduction ratio of at least 10%;
- said strip, in the ferritic phase, then undergoes a second hot rolling operation in one or more steps at a temperature below 850° C., with an overall reduction ratio of at least 50% in the presence of a lubricant, so as to obtain a hot-rolled strip having a thickness of less than or equal to 2 mm; and
- said strip then undergoes a complete recrystallization over its entire thickness by a soak between 700 and 800° C.

The strip optionally may then undergo cold treatments or may be cut up to form sheet which may be formed directly.

The subject of the invention is also a sheet obtained from strip produced by the above process.

DESCRIPTION OF THE PREFERRED EMBODIMENTS

The invention relies firstly on the use of a process for the direct casting of thin strip from liquid metal, a process known per se. The process for casting strip between two horizontal rolls which are internally cooled and rotating in opposite directions is well suited for this purpose. The strip emerging from the rolls is then subjected to thermomechanical and heat treatments which make it capable of undergoing the usual cold-treatment operations that are applied to hot-rolled strip obtained by conventional methods. Since the usual respective productivities of a plant for the direct casting of thin strip and of the plants for the cold treatment of said strip are very comparable, managing the production of drawable sheet is greatly simplified. It is even sometimes possible to completely dispense with the cold rolling step, needed in conventional lines, thereby making the manufacture of sheet, and of the products which result therefrom, more rapid and more economical.

The use of a plant for the twin-roll casting of thin strip in order to obtain carbon steel strip from 1.5 to 10 mm in thickness is now well known. In some cases (for example in document WO 95/26840 incorporated herein by reference), this strip undergoes in-line hot rolling. It is also known practice for this strip to undergo various heat treatments by in-line reheating and/or cooling cycles so as to have an influence on the metallurgical structure of the strip, for example to refine its grain size by $\alpha \rightarrow \gamma \rightarrow \alpha$ phase changes (see documents JP 61-189846 and JP 63-115654 both incorporated herein by reference).

The process according to the invention is particularly suitable for the manufacture of sheet having a high drawability, made of low-carbon steel (carbon content less than 0.1%, including less than 0.05% (preferred)) and ultralow-carbon steel (carbon content less than 0.007%). Its manganese content may vary from 0.03 to 2%, the highest contents (above 0.3%) providing steels with a particularly high strength. Its silicon content may range from 0 to 0.5% and its phosphorus content ranges from 0 to 0.1%. Additions of boron (up to 0.002%) and of titanium (up to 0.15%) are possible. Preferably, these steels have a low nitrogen content. In the case of low-carbon steels, optimally the sum of the carbon and nitrogen contents does not exceed 0.03%. In the case of ultralow-carbon steels, optimally the sum of the carbon and nitrogen contents should not exceed 0.007%. These ultralow-carbon steels may also contain small amounts of elements such as titanium and niobium (with Ti+Nb not exceeding 0.04%), the function of which is thought to trap the carbon and the nitrogen in the form of carbonitrides. Other chemical elements resulting from the smelting of the metal may be present as impurities that do not radically modify the properties of the sheet obtained thanks to the compositions that have just been described. Ultralow carbon and nitrogen contents are preferred since, given the manufacturing process of the sheet according to the invention, these elements will be in solid solution during the deformation; their presence may create dynamic ageing problems during deformation and therefore increase the rolling forces to be applied in the ferritic range.

In accordance with the process according to the invention, thin strip 1.5 to 10 mm in thickness, usually 1.5 to 4 mm in thickness is cast directly from liquid metal. As mentioned, twin-roll casting of this strip is well suited to this process and to the thicknesses most commonly cast, and it is this nonlimiting example that will be considered in the rest of the description.

The solidified strip leaving the casting space bounded by the rolls then optimally passes through a zone in which measures are taken to prevent, or at the very least greatly limit, the formation of scale on its surface, such as a chamber inerted by a nonoxidizing atmosphere, i.e., a neutral atmosphere (nitrogen or argon) or a reducing atmosphere (a hydrogen-containing atmosphere), in which chamber the oxygen content is lowered as far as possible. It is also possible to choose to leave the scale to form naturally over a certain distance and then to remove the scale formed, for example by means of brushes or of a device which blasts shot or solid $CO_2$ particles onto the surface of the strip. Such a device may also be installed downstream of an inerting zone in order to remove the small amount of scale that would possibly have formed therein.

Immediately after the inerting zone or descaling zone (when these are present), the strip undergoes a first in-line hot rolling operation. It is especially because of this rolling that the presence of scale on the surface of the strip must optimally be removed, since when scale is present the rolling forces are larger than when it is absent. In addition, the scale may be encrusted into the surface of the strip during rolling and the end-product obtained then has a poor surface finish, which may make this end-product unsuitable for the more demanding uses from this standpoint. This first rolling operation takes place within the temperature range lying between 950° C. and the $Ar_3$ temperature of the grade cast, that is to say in the lower part of the austenitic range. This rolling is thought to have several purposes. On the one hand, it makes it possible to close up the central pores which might possibly have formed in the core of the strip during its solidification. On the other hand, it "breaks" the microstructure resulting from the solidification and allows the formation of ferrite grains from a work-hardened austenite. Finally, it is thought to have a beneficial effect on the surface finish of the strip, by reducing its roughness. To achieve these objectives, a minimum reduction ratio of 10% should be provided, and a ratio of about 20% is typically used. It is generally obtained by passing the strip through a single rolling stand comprising, in a known manner, a pair of work rolls (and possibly support rolls), but it may be achieved progressively, by passing the strip through several of such stands in succession.

After this first hot rolling operation in the austenitic phase, the strip is then left to cool and to pass into the ferritic range, in which the strip will undergo a second hot rolling operation. This cooling may take place naturally, by simple radiation from the strip in the open air, or it may be achieved forcibly by spraying air or water onto the surface of the strip, thereby shortening the path traveled by the strip between the two rolling steps. The forced cooling may take place before, during or after the ferritic transformation of the strip, or at several of these stages, depending on what the operator chooses. The precise conditions under which the forced cooling is carried out depend on the operating parameters of the casting run, such as the thickness of the strip, its run speed, the distance between the two rolling mills, etc. All are within the skill of the ordinary worker. The essential point is that, when the strip undergoes its second hot rolling operation, it is in the ferritic. range at a temperature below 850° C. preferably below 750° C., in order to have a work-hardened structure and to avoid recrystallization.

This second hot rolling operation takes place with a reduction ratio of at least 50%, preferably at least 70%, obtained by passing the strip through a single stand or through several successive stands. The objective of the rolling is to develop textures in the product, textures which will subsequently be conducive to drawability properties. The high deformation ratios will also favor the development of the {111} crystal orientation during future recrystallization. This rolling must be carried out in the presence of a lubricant, so as to make the textures homogeneous through the thickness of the sheet, preventing the development of shear textures a quarter of the way through the thickness of the strip. This also makes it possible to reduce the forces to be exerted on the strip during ferritic deformation.

It is possible to provide between the first and second hot rolling operations, should this be desired or seem necessary for its ultimate purpose, means for inerting and/or descaling the strip similar to or the same as those means described previously, so as to avoid carrying out the second rolling operation on strip with a light scale. Because of the high reduction ratios applied during the second hot rolling operation, steps must be taken to prevent the scale from being encrusted at this stage if it is desired to obtain strip with an excellent surface finish.

After the second rolling operation, the strip in the ferritic state must be recrystallized. For this purpose, it may be coiled at high temperature, between 700 and 800° C. (typically 750° C.), so that its recrystallization is complete over its entire thickness and so as to ensure that an optimum texture is obtained. If after the second rolling operation the temperature of the strip is below 700° C., the strip must be reheated in order to bring it back into the desired temperature range. This reheat will, in most cases, raise the temperature of the strip by about one hundred degrees and may be achieved by passing it through an induction furnace. The advantage of an induction furnace over a furnace equipped, for example, with gas burners is that it allows the product to be reheated rapidly and, above all uniformly over the entire thickness of the strip. Thus, the recrystallization may then take place at least for the most part during this reheat. The strip reheat rates that may usually be obtained using induction furnaces of standard configuration and standard power (from 0.5 to 1.5 $MW/mm^2$ of strip) make it possible to obtain an approximately 100° C. reheat of a strip 0.75 mm in thickness in a furnace approximately 2 m in length. It is therefore quite possible to install such a furnace between the second rolling plant and the coiling plant on a conventional thin-strip casting line without extending the latter immeasurably. To reheat the thinnest strips, it may be profitable to use a transverse-flux inductor, the power of which may be up to 1 to 3 $MW/mm^2$ of strip, as described in the document "High flux induction for the fast heating of steel semi-product in line with rolling" by G. Prost, J. Hellegouarc'h, J-C. Bourhis and G. Griffay, Proceedings of the XIII International Congress On Electricity Applications, Birmingham, June 1996, incorporated herein by reference.

The hot-treated sheet obtained by the process according to the invention has a thickness of less than or equal to 2 mm, preferably less than or equal to 1 mm, depending on the thickness of the initial strip and on the rolling ratios that are applied to it. Depending on the envisaged application, it is possible to use the sheet directly, especially if its thickness is particularly small, for example less than 0.7 mm (whereas the hot-treated sheet obtained by the conventional processes is too thick for direct use), or to subject it thereafter to the usual "cold" treatment operations: one or more of cold rolling, annealing (continuous annealing or box annealing) and skin-pass rolling, especially if it is desired in the end to obtain very thin sheet. Added to these operations may be the usual surface treatments (descaling, pickling, etc.) which accompany them in the conventional processes for manufacturing sheet for drawing.

Finally, since the speed at which the strip leaving the second hot rolling mill runs is generally less than 250 m/mn, it is compatible with that for carrying out, in line, at least the first of said "cold" transformation operations. In particular, if it was possible to achieve, by means of the reheat, complete recrystallization during the second rolling operation, it is conceivable to dispense with the coiling operation and to introduce the strip (after having possibly cooled it or left it to cool to a suitable temperature) directly into one or more successive "cold" treatment plants: cold rolling mill, continuous annealing, skin-pass rolling, coating line.

French patent application 99 07660 filed Jun. 17, 1999 is incorporated herein by reference.

What is claimed is:

1. A process for manufacturing strip, comprising:

casting directly from liquid metal a steel strip 1.5 to 10 mm in thickness having a composition in percentages by weight comprising: carbon less than 0.1%, manganese from 0.03 to 2%, silicon from 0 to 0.5%, phosphorus from 0 to 0.1%, boron from 0 to 0.002%, titanium from 0 to 0.15%, iron and impurities resulting from the smelting;

subjecting said cast steel strip, in the austenitic phase, to a first hot rolling operation in one or more steps at a temperature of between 950° C. and the $Ar_3$ temperature of said strip with an overall reduction ratio of at least 10%;

subjecting said hot rolled strip, in the ferritic phase, to a second hot rolling operation in one or more steps at a temperature below 850° C., with an overall reduction ratio of at least 50% in the presence of a lubricant, so as to obtain a hot-rolled sheet having a thickness of less than or equal to 2 mm; and recrystallizing said hot-rolled sheet having a thickness of less than or equal to 2 mm over its entire thickness at a temperature of between 700 and 800° C.

2. The process as claimed in claim 1, wherein the carbon content of the cast steel strip is less than 0.05%.

3. The process as claimed in claim 2, wherein the sum of the carbon and nitrogen contents of the cast steel strip does not exceed 0.03%.

4. The process as claimed in claim 1, wherein the carbon content of the cast steel strip is less than 0.007%.

5. The process as claimed in claim 4, wherein the sum of the carbon and nitrogen contents of the cast steel strip does not exceed 0.007%.

6. The process as claimed in claim 4, wherein the cast steel strip contains titanium and/or niobium with Ti+Nb not exceeding 0.04%.

7. The process as claimed in claim 5, wherein the cast steel strip contains titanium and/or niobium with Ti+Nb not exceeding 0.04%.

8. The process as claimed in claim 1, wherein the manganese content of the cast steel strip is between 0.3 and 2%.

9. The process as claimed in claim 1, wherein said cast steel strip is cast by casting the liquid metal between two horizontal rolls which are internally cooled and rotating in opposite directions.

10. The process as claimed in claim 1, wherein between the casting operation and the first rolling operation, the strip passes through a zone containing a non-oxidizing atmosphere and/or is subjected to a descaling operation.

11. The process as claimed in claim 1, further comprising forcibly cooling said hot rolled strip between the first and second hot-rolling operations.

12. The process as claimed in claim 1, wherein, between the first and second rolling operations, the hot rolled strip passes through a zone containing a non-oxidizing atmosphere and/or is subjected to a descaling operation.

13. The process as claimed in claim 1, wherein the second hot rolling operation is carried out with an overall reduction ratio of at least 70%.

14. The process as claimed in claim 1, wherein the second rolling operation is carried out at a temperature below 750° C.

15. The process as claimed in claim 1, wherein said recrystallization is obtained by coiling the strip between 700 and 800° C.

16. The process as claimed in claim 1, wherein said recrystallization is at least partly obtained by reheating the strip, raising its temperature to between 700 and 800° C. throughout its thickness.

17. The process as claimed in claim 1, further comprising, after recrystallization, subjecting the recrystallized strip to one or more cold treatments selected from the group consisting a rolling treatment, an annealing treatment, a skin-pass treatment, a dip-coating treatment and an electroplating treatment to provide a drawable sheet.

18. The process as claimed in claim 16, wherein at least the first of said cold treatments is carried out in line with the manufacture of the hot-rolled and recrystallized strip.

* * * * *